US005737877A

United States Patent [19]

Meunier et al.

[11] Patent Number: 5,737,877

[45] Date of Patent: Apr. 14, 1998

[54] BLOCK AND TACKLE BALANCE WITH INTEGRAL, NON-ROTATING PULLEY SYSTEM

[75] Inventors: Scott Meunier; Rick Skallerud; Larry VerSteeg, all of Sioux Falls; Gary Newman, Valley Springs, all of S. Dak.

[73] Assignee: Amesbury Group, Inc., Amesbuy, Mass.

[21] Appl. No.: 687,684

[22] Filed: Jul. 26, 1996

[51] Int. Cl.[6] ..... E05F 1/00

[52] U.S. Cl. ..... 49/445; 16/197

[58] Field of Search ..... 49/445, 447; 16/400, 16/401, 197, 193, 196, DIG. 10

[56] References Cited

U.S. PATENT DOCUMENTS

| | | | |
|---|---|---|---|
| 1,196,271 | 8/1916 | Patrick . | |
| 2,715,747 | 8/1955 | Prosser et al. | 49/447 X |
| 2,844,843 | 7/1958 | Logan . | |
| 2,987,758 | 6/1961 | Osten, Sr. . | |
| 3,012,292 | 12/1961 | Brengman . | |
| 3,222,733 | 12/1965 | Wahlfeld et al. . | |
| 3,358,403 | 12/1967 | Dinsmore | 16/197 X |
| 3,466,806 | 9/1969 | Teggelaar et al. . | |
| 3,475,864 | 11/1969 | Wood | 49/445 |
| 4,089,085 | 5/1978 | Fitzgibbon . | |
| 4,190,930 | 3/1980 | Prosser | 16/197 |
| 4,271,631 | 6/1981 | Trout | 49/181 |
| 4,332,054 | 6/1982 | Paist et al. | 16/197 |
| 4,570,382 | 2/1986 | Suess | 49/430 |
| 4,685,175 | 8/1987 | Yonovich | 16/197 |
| 4,697,304 | 10/1987 | Overgard | 49/445 X |
| 4,718,194 | 1/1988 | FitzGibbon et al. | 49/181 |
| 4,887,389 | 12/1989 | Haltof | 49/181 |
| 4,914,780 | 4/1990 | Rogers et al. | 16/DIG. 16 |
| 4,914,861 | 4/1990 | May | 49/181 |
| 4,914,862 | 4/1990 | Gregory | 49/445 X |
| 4,949,425 | 8/1990 | Dodson et al. | 16/198 |
| 5,027,557 | 7/1991 | May | 49/181 |
| 5,033,235 | 7/1991 | Stark | 49/445 |
| 5,036,622 | 8/1991 | Stark | 49/445 |
| 5,077,939 | 1/1992 | Erickson | 49/380 |
| 5,117,586 | 6/1992 | Stark | 49/445 |
| 5,174,064 | 12/1992 | Stark | 49/445 |
| 5,189,838 | 3/1993 | Westfall | 49/181 |
| 5,445,364 | 8/1995 | Tibbals, Jr. | 267/74 |
| 5,530,991 | 7/1996 | deNormand et al. | 16/198 |

FOREIGN PATENT DOCUMENTS

| | | |
|---|---|---|
| 1002338 | 8/1965 | United Kingdom . |
| 1218827 | 1/1971 | United Kingdom . |
| 1244324 | 8/1971 | United Kingdom . |

*Primary Examiner*—Jerry Redman

*Attorney, Agent, or Firm*—Testa, Hurwitz & Thibeault, LLP

[57] ABSTRACT

A block and tackle balance disposed between a jambliner and a window sash includes a spring and a non-rotating pulley system. A head block is disposed on a rod for attaching the balance to the jambliner and securing one end of the spring, and a slide block is disposed at about the midpoint of the rod for securing the other end of the spring. The slide block acts in combination with a base block and a pulley cord, to create the non-rotating pulley system. The slide block and the base block each have at least one cord-receiving channel formed in a raised u-shaped member, for slidably receiving the pulley cord. The base block further includes a bore for securing an end of the pulley cord, and is coupled via the pulley cord to a shoe, which moves in response to movement of the window sash. As the shoe moves, the cord slides within the channels, and the slide block moves toward the base block. The displacement of the slide block relative to the fixed head block, results in a change in the length of the spring such that the spring supports the new position of the window sash.

25 Claims, 5 Drawing Sheets

BLOCK AND TACKLE BALANCE WITH INTEGRAL, NON-ROTATING PULLEY SYSTEM

FIELD OF THE INVENTION

This invention relates generally to the field of spring balances for window sashes, particularly, an improved block and tackle spring balance.

BACKGROUND OF THE INVENTION

Balance systems are used with single-hung, double-hung, and tilting windows to maintain the windows sashes at certain positions along the window jamb, and to reduce the forces needed to move each window sash. These systems are typically installed within the space defined between a sash and a jamb, and possess force-resisting elements that counterbalance gravitational forces. One type of balance system, known as a block and tackle balance, has become quite popular in recent years due to the relative ease by which it balances forces acting upon a window sash. Block and tackle balances generally include a spring coupled with a rotating pulley system that transmits a force from the sash to the spring. Due to the use of a pulley system, block and tackle balances can utilize springs of reduced length, and thus achieve a more compact design.

Conventional block and tackle balances, although compact, are often quite complicated, and many do not lend themselves to automated manufacture. For example, many block and tackle balances rely on intricate frames to aid in installation between the jamb and the sash, or to facilitate sash removal for cleaning or repair. Other block and tackle balances utilize intricate pulley systems to reduce the load on the spring. The increased intricacy of conventional block and tackle balances has lead to an increased difficulty in fabrication. Moreover, fabrication of such balances frequently requires the individual attention of the machine operator to ensure that they meet desired specifications. As a result, these balances are often costly.

Additionally, conventional block and tackle balances typically rely on a plurality of rotating wheels or sheaves. Such elements add complexity to the maintenance of a block and tackle balance, as they require frequent lubrication for continued rotation. After lubrication, lubricants and residue are often left on the jambliner and window sill, necessitating clean-up of such areas for operational and aesthetic reasons. Additionally, such rotating elements are prone to wear and tear, further increasing the costs associated with maintaining the balance.

In addition to the above-noted problems, conventional block and tackle balances often have faulty spring designs that subject the spring to undue stress. Such stress may result in damage to the spring and other balance components. Additionally, most block and tackle balances attach the spring to other balance elements with a simple hook design, permitting the spring to easily disengage from such elements in response to slight angular movement of the spring. As a result, conventional balances often require frequent spring replacement and reattachment for continued operation.

It is an object of the invention, therefore, to provide a block and tackle balance which affords improved strength and resistance to wear. Another object of the invention is to provide a block and tackle balance which is of a simple and cost effective construction. Still another object of the invention is to provide a block and tackle balance which requires less maintenance than conventional block and tackle balances.

SUMMARY OF THE INVENTION

These and other objects are achieved by the block and tackle balance of the present invention. In one embodiment of the invention, the block and tackle balance comprises a spring, a non-rotating pulley system coupled to the spring, and a rod disposed within the spring and along the non-rotating pulley system, acting as a support member. In an alternative embodiment, the present invention may comprise a spring and a non-rotating pulley system.

In other embodiments, the present invention includes a head block fixedly mounted at one end of the rod, having a retaining member securing the balance to the jambliner, and a securing member attaching the spring to the head block. Slidably disposed at about the midpoint of the rod is a slide block having a pair of channels defined in opposed walls of the block for receiving a pulley cord, and a securing member attaching the spring to the slide block. A base block is fixedly mounted at the end of the rod opposite the head block, having a channel defined in one wall of the block for receiving a pulley cord, and a pair of bores defined in another wall of the block, one of which receives the cord, and the other of which secures an end of the cord. A shoe is movably disposed adjacent the base block, and includes a member for securing the shoe to the window sash such that the shoe moves with the window sash. A bore is defined in one wall of said shoe, and aligned with one of said bores in the base block for receiving the other end of the pulley cord. A pulley cord is disposed between the slide block, the base block, and the shoe to facilitate sliding of the slide block and subsequent movement of the spring.

In another embodiment, the pulley cord defines an alternating path between the base block and the slide block, and extends from the bore in the base block to a channel in the slide block, to a channel in the base block, returning to a channel in the slide block, back through a bore in the base block, and to a bore in the shoe. The pulley cord is retained at the base block and at the shoe by a pair of knots, each formed at an end of the cord. When a force is exerted on the window sash, the shoe moves with respect to the base block, and the tensioned pulley cord slidably moves within the channels in a relatively frictionless path, causing the slide block to slide along the rod away from the head block, resulting in a change in the length of the spring.

In some embodiments, the spring of the present invention further includes mounting coils disposed at its ends, and the head block and the slide block each further include a protrusion for receiving a mounting coil. In other embodiments, the head block further includes a hook that is received in the jambliner, and the shoe includes an opening for receiving a pin to secure the shoe to the window sash.

These and other features of the invention will be more fully appreciated by reference to the following detailed description which is to be read in conjunction with the attached drawings.

DETAILED DESCRIPTION OF THE INVENTION

Figure 1:
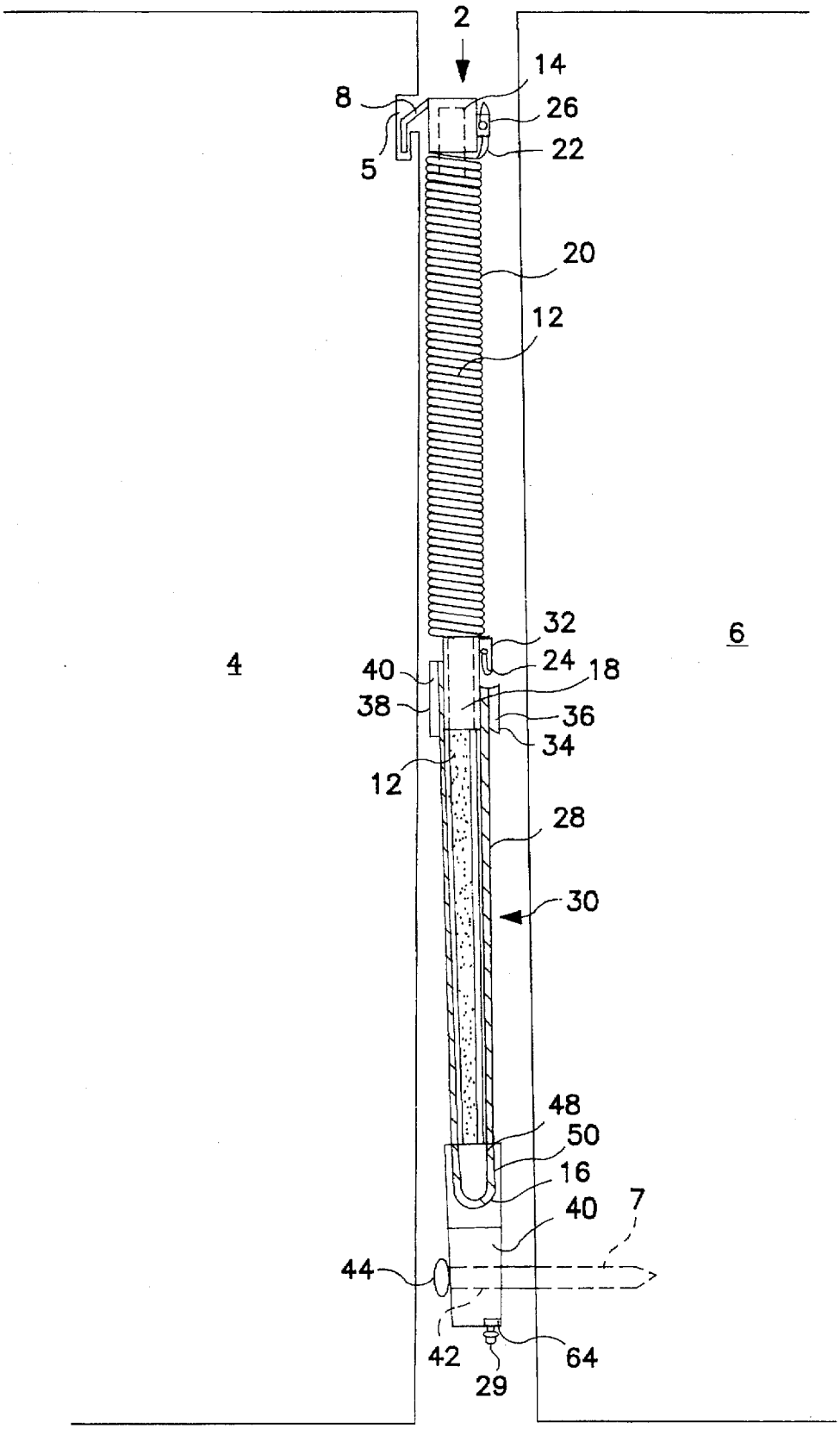
FIG. 1 is a side view, partly in section, showing the balance of the present invention disposed between a jambliner and a window sash.

Referring to FIG. 1, a partial sectional view of the block and tackle balance 2 of the present invention is shown in the environment in which it is used, that is, coupled to a jambliner 4 and a window sash 6. The window sash 6 generally reciprocates and tilts within a space (not shown) defined in the jambliner 4, and is retained at a desired position along the jambliner 4 with the aid of the balance 2. The forces needed to manipulate the window sash 6 to a desired position are reduced by the balance 2 of the present invention.

In one embodiment of the present invention, the balance 2 includes a rod 12, a spring 20, a non-rotating pulley system 30, and a shoe 40. The rod 12 acts as the main support for the balance 2, and is typically fabricated from pultruded fiber glass. A head block 14 is mounted at one end of the rod 12 for attaching the balance 2 to the jambliner 4, and a base block 16 is mourned at the other end for coupling the pulley system 30 to the shoe 40. A slide block 18 is mounted at about the midpoint of the rod 12, and in combination with the head block 14, secures a spring 20 that encircles the rod 12 from the head block 14 to the slide block 18. The slide block 18 and the base block 16, in cooperation with a cord 28, form the non-rotating pulley system 30 that enables the spring 20 to move in response to movement of the shoe 40. The cord 28 can be a string, a rope, or a cable, and is preferably of sufficient tension strength to resist breakage when pulled. In another embodiment of the invention, the balance 2 need not include the rod 12, but rather may rely on the spring 20 and the blocks 14, 16, 18 for support. The blocks 14, 16, 18 are typically fabricated from a plastic having sufficient hardness characteristics.

The head block 14 and the base block 16 are preferably fixedly mounted on the rod 12 and the slide block 18 is preferably slidably mounted on the rod 12. In the illustrated embodiment, a retaining member 8 extends from an opposite surface of the head block 14 and is inserted into an opening or ridge 5 formed in the jambliner 4, thus securing the balance 2 to the jambliner 4. In the illustrated embodiment, the retaining member 8 can be removably disposed in the opening 5 to facilitate later removal of the balance 2 and/or the window sash 6. The shoe 40 has an opening 42 defined therein for receiving a pin 44. The pin 44 is driven through the opening 42 and into an opening 7 in the window sash 6. By securing the shoe 40 to the window sash 6, any reciprocating or tilting movement by the sash 6 is transmitted to the shoe 40, and in turn, to the spring 20.

Figure 2A:
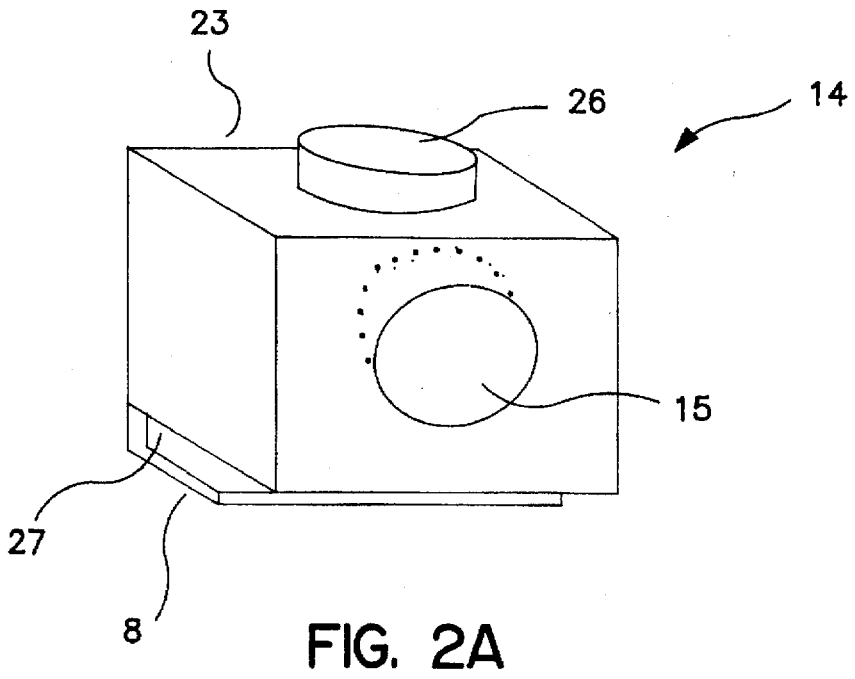
FIG. 2A is a perspective view of the head block of the present invention.

Referring to FIG. 2A, shown is a perspective view of one embodiment of the head block 14. A central bore 15 extends inwardly from the front surface 17 to about the midpoint of the head block 14 to receive the rod 12. A protrusion 26 is formed on the top surface 23 to receive a mounting coil (22) (not shown). The retaining member 8 is formed on the bottom surface 37, opposite the protrusion 26 for attachment to the jambliner 4. In the present embodiment, the protrusion 26 is generally configured as a circular member, which forms a friction fit with the circular mounting coil (22) (not shown). The retaining member 8 is generally configured as a hook, however, other configurations can be used. Referring again to FIG. 1, the protrusion 26 on the head block 14 receives a mounting coil 22 disposed on an end of the spring 20, thus securing the spring to the head block 14. As the head block 14 remains stationary during operation of the balance 2, the end of the spring 20 secured by the mounting coil 22 also remains stationary.

Figure 2B:
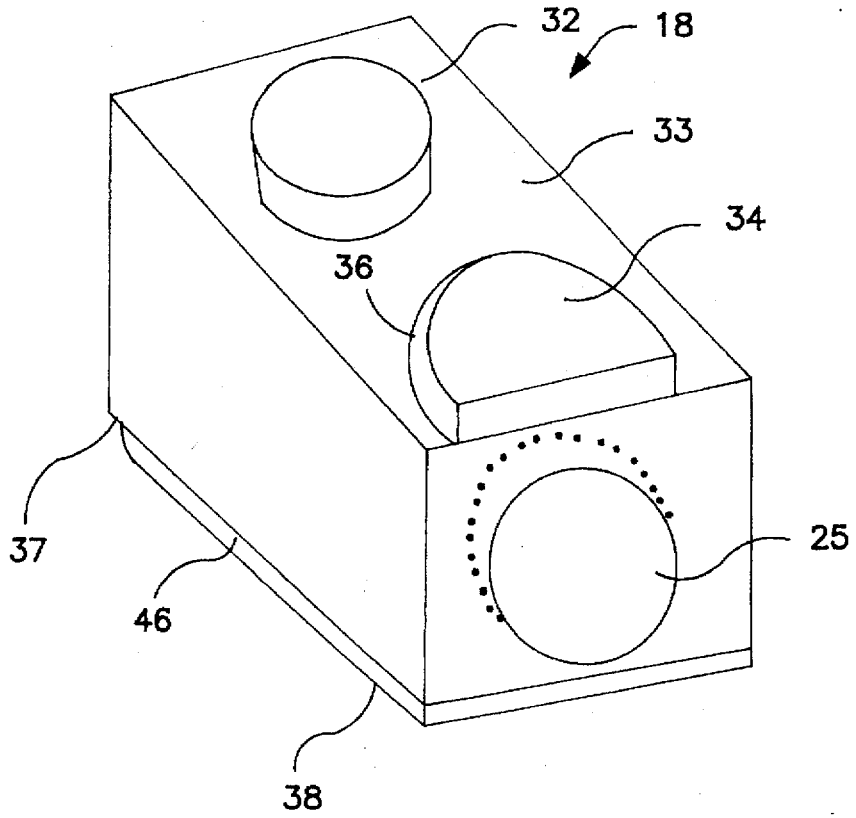
FIG. 2B is a perspective view of the slide block of the present invention.

Referring to FIG. 2B, shown is a perspective view of one embodiment of the slide block 18. As shown, a central bore 25 is formed through the length of slide block 18 to receive the rod 12. Disposed on the top surface 33 of the slide block 18 is a protrusion 32. Adjacent the protrusion 32 on the top surface 33, is a raised u-shaped member 34 having a channel 36 defined therein. In the illustrated embodiment, the channel 36 defines a generally a u-shaped path around the u-shaped member 34, however, the channel 36 may define other generally circular paths. Disposed on the bottom surface 37 opposite the protrusion 32, is yet another raised u-shaped member 38 having a channel 46 defined therein, also defining a generally u-shaped path. The channels 36, 46 are typically integrally formed in the slide block 18, preferably forming a concave depression or ridge that is sized to slidably receive the cord (28) (not shown). Referring again to FIG. 1, the protrusion 32 on the slide block 18 receives a mounting coil 24 disposed on an end of the spring 20, thus securing the spring 20 to the slide block 18. As will be further described, the slide block 18 slides along the rod 12 during operation of the balance 2. This movement of the slide block 18 causes the spring 20 to extend or retract, as further shown in FIGS. 4A and 4B. Still referring to FIG. 1, shown within the channels 36 and 38 are portions of the cord 28, which as will be further described in FIG. 3, forms a non-rotating pulley system 30 with the channel 50 formed in the base block 16.

Figure 2C:
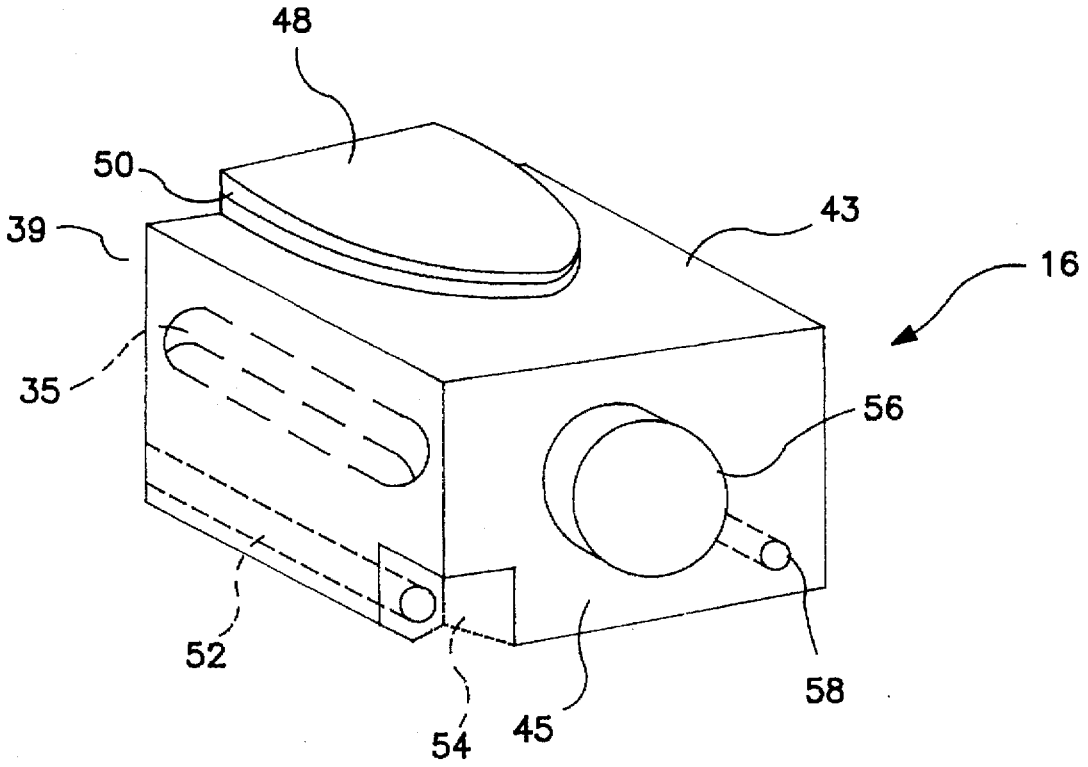
FIG. 2C is a perspective view of the base block of the present invention.

Referring to FIG. 2C, shown is a perspective view of one embodiment of the base block 16. A central bore 35 is formed in the base block 16, extending from the back surface 39 to about the midpoint of the base block 16. The central bore 35 receives the rod 12. A raised u-shaped member 48 is formed on the top surface 43 of the base block 16, and has a channel 50 defined therein, defining a generally u-shaped path. The channel 50, like those described above, is preferably integrally formed in the block, forming a concave depression to slidably receive the cord 28. A small diameter bore 52 is formed within and through the base block 16, extending from the back surface 39 and terminating in a cut-out portion 54 of the base block 16. As will be further shown, the bore 52 receives a portion of the cord 28 and the cut-out portion 54 retains a knot (27) (not shown), a plastic block, or other retaining member disposed on one end of the cord 28. By retaining an end of the cord 28 in the cut-out portion 54, the knot (27) (not shown) or other retaining member causes the cord 28 to lie within the channels 36, 46, 50 at a certain tension. Additionally formed within and through the base block 16, generally parallel to the bore 52, is a bore 58, also sized to slidably receive the cord 28. The cord 28 travels through this bore 58 to the shoe 40 where it terminates in a knot 29, plastic block, or other retaining member. In this embodiment, a plug member 56 emanates from the front surface 45, for mating with a cooperating socket member in the shoe 40. The plug 56 may comprise a round square or other shaped member extending from the surface 45.

Figure 2D:
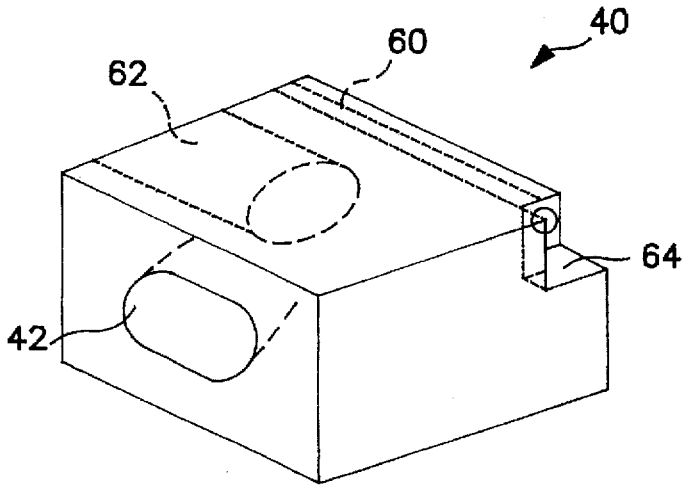
FIG. 2D is a perspective view of the shoe of the present invention.

Referring to FIG. 2D, shown is a perspective view of one embodiment of the shoe 40 of the present invention. As stated above, the shoe 40 includes an opening 42 defined therein for receiving a pin 44 for attachment to the window sash 6 such that movement of the window sash 6 is transmitted to the shoe 40. Additionally formed within the shoe 40 is a bore 60 sized to slidably receive the cord 28. The bore 60 is preferably aligned with the bore 58 formed in the base block 16, such that the cord 28 is continuously threaded from the bore 58 to the bore 60. The bore 60 in the shoe 40 terminates in a cut-out portion 64. Referring to FIG. 1, in the illustrated embodiment, the cut-out portion 64 retains a knotted end 29 of the cord 28. As stated above, other retaining members can be used, such as, for example, plastic members (not shown) affixed to the ends of the cord 28. Referring again to FIG. 2D, in the illustrated embodiment, the rod 12 does not run through the shoe 40, as the rod 12 generally remains stationary during operation of the balance, and the shoe 40 moves with the window sash 6.

In the illustrated embodiment, the shoe 40 is thus coupled to the remainder of the balance 2 via the cord 28 which extends from the cut-out 64, through the bore 60, and to the base block 16. As will be further described below, the shoe 40 exerts a force on the remainder of the balance 2 through the cord 28. The shoe 40 further includes a socket 62 for mating with the plug member 56 when the shoe 40 is stationary as shown in FIG. 1.

Figure 3:
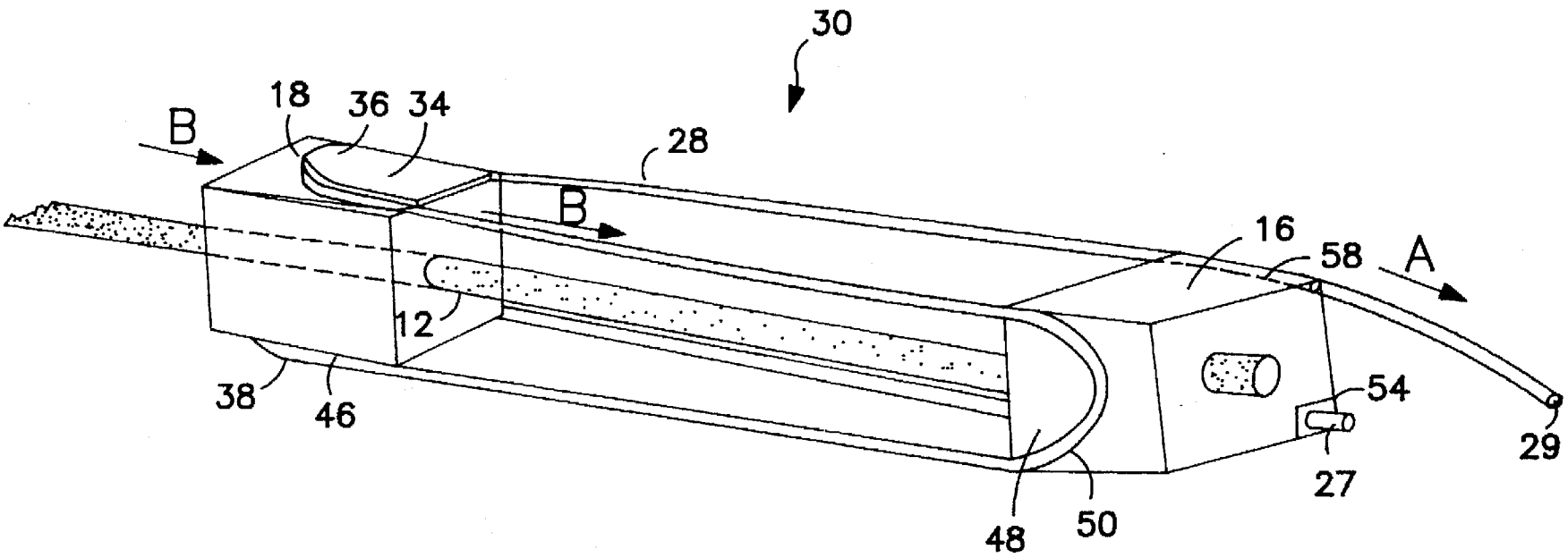
FIG. 3 is a perspective view of the non-rotating pulley system of the present invention.

Referring to FIG. 3, one embodiment of the non-rotating pulley system 30 of the present invention is described in further detail. As shown, the cord 28 is alternatingly disposed in a path between the base block 16 and the slide block 18. The cord 28 extends from the knotted end 27, secured by the cut-out 54 of the base block 16, to the slide block 18, particularly to the channel 46 formed in the raised u-shaped member 38. The cord 28 is disposed within the channel 46 and wound around the u-shaped member 38, such that any movement of the cord 28 causes it to slide within the channel 46 and around the u-shaped member 38. Such sliding motion is relatively frictionless, and operates in a manner similar to a pulley.

The cord 28 then extends to the u-shaped member 48 in the base block 16. Similarly, the cord 28 is slidably disposed within the channel 50 such that movement of the cord 28 causes it to slide around the u-shaped member 48. The cord 28 then extends back to the slide block 18 and is slidably disposed within channel 36 formed in the u-shaped member 34. The cord 28 then extends back to the base block 16 and through the bore 58 to connect with the shoe (40) (not shown). For purposes of illustration only, the knotted end 29 of the cord 28 is shown without the retaining feature of the cooperating cut-out (64) in the shoe (40).

In operation, the shoe (40) exerts a force on the knotted end 29 of the cord 28 in response to movement of the window sash (6). In response, the knotted end 29 moves in the direction in which the shoe (40) is being pulled, shown in this figure by arrow A. As the remainder of the cord 28 follows the knotted end 29 that is being pulled, the cord 28 slides within the channels 36, 50, 46 around each of the raised u-shaped members 34, 48, 38. As a result, the slide block 18 moves along the rod 12 in the direction shown by arrow B, while the base block 16 remains stationary. The tension created by the retaining force created by the knot 27 disposed in the cut-out portion 54, aids in the movement of the slide block 18 along the rod 12 relative to the base block 16. As shown, the cord 28 slides within the channels 36, 50, 46, simulating the movement of a pulley. As will be further illustrated below, the pulley system 30 causes displacement of the slide block 18 relative to said head block (14) (not shown) resulting in a corresponding change in the length of the spring (20) (not shown), such that the spring (20) can support the window sash (6) (not shown) in its new position.

Figure 4A:
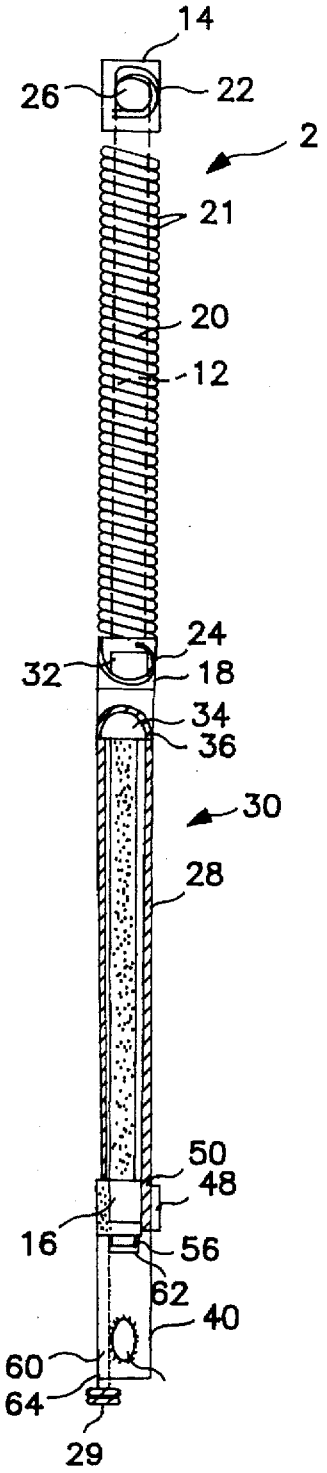
FIG. 4A is a front elevational view of the balance system of the present invention.
Figure 4B:
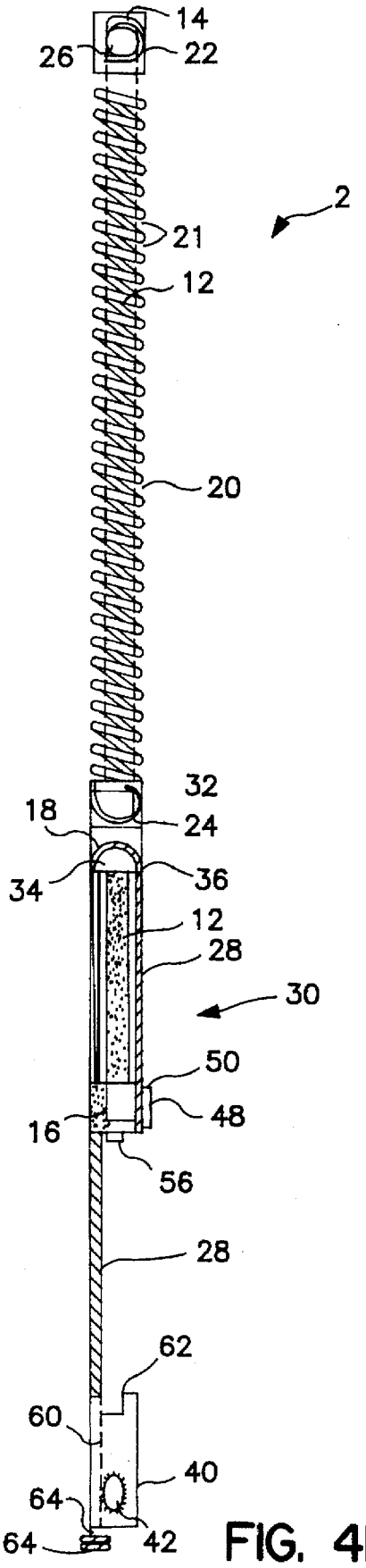
FIG. 4B is a front elevational view of the balance system of the present invention in a state where the spring is extended.

Referring to FIGS. 4A and 4B, the operation of the balance 2 of the present invention is described in further detail. FIG. 4A shows a front elevational view of the balance 2 of the present invention. As shown in this figure, the balance 2 is in a natural state, that is, a state where the window sash (6) (not shown) is stationary, and the force exhibited by the window sash (6) is being maintained by the balance 2. In this state, the base block 16 and the shoe 40 are in close proximity, as the plug 56 of the base block 16 is mated with the bore 62 of the shoe 40. Note that the spring 20 is in a non-extended position and the slide block 18 resides at about the midpoint of the rod 12. The balance 2 is typically in this state when an upper window sash (6) is being held in the upper part of the window frame.

Referring to FIG. 4B, a front elevational view of the balance of the present invention is shown in a state where the shoe 40 is being acted upon by the movement of a window sash (6) (not shown). In the illustrated embodiment, the shoe 40 is spaced from the base block 16 due to a force exhibited on the shoe 40 by the window sash (6), pulling the shoe 40 in a direction away from the base block 16. This force could be generated, for example, by a downward manual force on an upper window sash (6). As the shoe 40 is pulled by the moving window sash,(6) the length of the cord 28 between the shoe 40 and the base block 16 increases. At the same time, the cord 28 travels within the channels 36, 50, 46, and causes the slide block 18 to slide along the rod 12 closer to the base block 16, thus shortening the length of the cord 28 between the base block 16 and the slide block 18. As the slide block 18 moves, the protrusion 32 fixed to the slide block 18, travels therewith, exerting a force on the mounting coil 24. This causes the spring 20 to be pulled in the direction of the shoe 40. The mounting coil 22 at the other end of the spring 20 remains fixed to the head block (14), which remains stationary. The continued displacement of the slide block 18 relative to the stationary head block 14 thus increases the tension in the spring 20. This force on spring 20 causes the distance between the individual coils 21 to expand, thus lengthening the spring 20. The shoe 40 continues to move with the sash (6) until the sash (6) reaches a desired position, at which point the tension in the spring 20 retains the sash (6) at the desired position. The balance 2 is typically in this expanded state when the upper window sash (6) reaches the lower part of the window frame.

While various embodiments of the invention have been set forth in detail, it should be understood that the above description is intended as illustrative rather than limiting and that many variations to the described embodiments will be apparent to those skilled in the art. The invention is to be described, therefore, not by the preceding description, but by the claims that follow.

What is claimed is:

1. A balance system comprising:

a resilient member having a first end spaced along a length from a second end;

a head block including a mechanism for securing said first end of said resilient member and a structure for securing said head block to a jambliner;

a slide block including a first channel defined therein, and a mechanism for securing said second end of said resilient member;

a base block including a second channel defined therein and a first retaining member;

a shoe movably disposed adjacent said base block, including a structure for coupling to a window sash, and a second retaining member; and a cord slidably disposed within said first channel in said slide block and said second channel in said base block, said cord having a pair of ends retained by said first and second retaining members, such that movement of said shoe causes said cord to slide within said channels causing displacement of said slide block relative to said head block, and a corresponding change in said length of said resilient member.

2. The balance system of claim 1, wherein each of said first and second channels defines a u-shaped path.

3. The balance system of claim 1, wherein each of said first and second channels is concave.

4. The balance system of claim 1, further comprising a rod-like member disposed within an interior space defined by said spring.

5. The balance system of claim 4, wherein said head block is fixedly disposed on said rod-like member.

6. The balance system of claim 4, wherein said slide block is slidably disposed on said rod-like member.

7. The balance system of claim 4, wherein said base block is fixedly disposed on said rod-like member.

8. The balance system of claim 7, wherein said shoe is movable with respect to said base block.

9. The balance system of claim 1, wherein said shoe is movable in response to the movement of the window sash.

10. The balance of claim 1, said slide block having a plurality of channels defined therein.

11. The balance system of claim 1, said slide block having a pair of opposed u-shaped surfaces and a channel defined in each opposed u-shaped surface.

12. The balance system of claim 1, said base block having a pair of opposed surfaces, wherein said second channel is defined in one of said opposed surfaces, and said first retaining member is defined in the other of said opposed surfaces.

13. The balance system of claim 12, wherein said first retaining member on said base block and said second retaining member on said shoe are in alignment.

14. The balance system of claim 13, wherein said first and second retaining members are each defined by a bore extending through said base block and said shoe, respectively, each bore receiving one of said pair of ends of said cord.

15. The balance system of claim 1, wherein said base block and said shoe interconnect via a plug and socket connection.

16. A spring balance comprising:

a rod-like member having a first end, a second end, and a middle portion;

a spring disposed about said rod-like member, said spring having a first end spaced along a length from a second end;

a head block fixedly disposed at said first end of said rod, said head block being coupled to a jambliner, and including a structure for securing said first end of said spring;

a slide block slidably disposed at said middle portion of said rod, said slide block having a first channel defined in one wall of said slide block, a second channel defined in another wall of said slide block, and a structure for securing said second end of said spring;

a base block fixedly disposed at said second end of said rod, said base block having a third channel defined in one wall of said block, a pair of bores defined in another wall of said block;

a shoe movably disposed adjacent said base block, said shoe being coupled to a window sash, and including a bore defined in one wall of said shoe, and aligned with one of said pair of bores in said base block; and a cord having a first end retained at one of said pair of bores in said base block and a second end retained at said bore in said shoe, said cord defining an alternating path between said base block and said slide block, said path extending from one of said pair of bores in said base block to said first channel in said slide block, to said third channel in said base block, back to said second channel in said slide block, through said other bore of said pair of bores in said base block, and to said bore in said shoe;

whereby a force exerted by the window sash on said shoe changes said length of said spring.

17. The spring balance of claim 16, wherein each of said channels defines a u-shaped path.

18. The spring balance of claim 16, wherein said cord cooperates with said channels to form a non-rotating pulley system.

19. The spring balance of claim 16, wherein said base block and said shoe interconnect via a plug and socket connection.

20. A balance comprising:

a resilient member having a first end spaced along a length from a second end;

a head block coupled to said first end of said resilient member;

a non-rotating slide block coupled to said second end of said resilient member and including a first channel integrally formed therein;

a base block including a second channel integrally formed therein;

an elongated member extending from said head block to said base block, for maintaining stationary said head block and said base block; and a tensioned cord slidably disposed within said first channel in said slide block extending to, and slidably disposed within said second channel in said base block, such that movement of said cord within said first and second channels causes displacement of said slide block relative to said head block, and a corresponding change in said length of said resilient member.

21. A balance comprising:

a resilient member having a first end spaced along a length from a second end;

a securing member coupled to said first end of said resilient member;

a slide block free of rotational parts, coupled to said second end of said resilient member, said slide block having a first channel integrally formed therein;

a base block including a curved member having a second channel formed therein; and a cord slidably disposed within said first channel, said cord extending to and slidably disposed within said second channel, such that movement of said cord within said first and second channels causes displacement of said slide block and a corresponding change in said length of said resilient member.

22. The balance of claim 21, said securing member comprising a head block.

23. The balance of claim 21, said curved member comprising a raised portion integrally formed with said base block.

24. The balance of claim 21, further comprising an elongated member coupled to said securing member and said base block for maintaining stationary said securing member and said base block.

25. The balance of claim 21, said slide block comprising a substantially solid rectangular member.

* * * * *

UNITED STATES PATENT AND TRADEMARK OFFICE

CERTIFICATE OF CORRECTION

PATENT NO. : 5,737,877
DATED : April 14, 1998
INVENTOR(S) : Meunier, et. al.

It is certified that error appears in the above-identified patent and that said Letters Patent is hereby corrected as shown below:

Title page, item [54] and col. 1, lines 1-3, the title should read -- Block and Tackle Balance With Integral Pulley System --.

Signed and Sealed this

Ninth Day of February, 1999

*Attest:*

*Acting Commissioner of Patents and Trademarks*

*Attesting Officer*